US010913009B2

(12) United States Patent
Hyslop

(10) Patent No.: US 10,913,009 B2
(45) Date of Patent: Feb. 9, 2021

(54) GEOMETRIC TOY

(71) Applicant: Munch Baby Inc., Burlington (CA)

(72) Inventor: Melissa L Hyslop, Burlingon (CA)

(73) Assignee: Munch Baby Inc., Ontario (CA)

( * ) Notice: Subject to any disclaimer, the term of this patent is extended or adjusted under 35 U.S.C. 154(b) by 0 days.

(21) Appl. No.: 16/284,009

(22) Filed: Feb. 25, 2019

(65) Prior Publication Data

US 2019/0262738 A1 Aug. 29, 2019

Related U.S. Application Data

(60) Provisional application No. 62/634,941, filed on Feb. 26, 2018.

(51) Int. Cl.
*A63H 33/04* (2006.01)
*A63H 33/10* (2006.01)
*A63H 33/08* (2006.01)

(52) U.S. Cl.
CPC ..... *A63H 33/105* (2013.01)

(58) Field of Classification Search
CPC ..... A63H 33/00; A63H 33/04; A63H 33/08; A63H 33/086; A63H 33/065; A63H 33/088; A63H 33/10; A63H 33/105; A01K 15/00; A01K 15/025; A01K 15/026
USPC ..... 446/75–77, 121–126, 418–419, 486; 119/702, 706–711
See application file for complete search history.

(56) References Cited

U.S. PATENT DOCUMENTS 3,633,587 A * 1/1972 Hunt ..... A63H 5/00 606/235
4,003,144 A * 1/1977 Maddestra ..... A63F 9/0098 434/403
5,224,959 A 7/1993 Kasper
5,395,279 A 3/1995 McCann
5,458,522 A * 10/1995 Brooks, III ..... A63H 33/048 446/85
6,729,984 B2 5/2004 Silverglate
8,052,552 B2 11/2011 Silverglate
8,382,548 B2 * 2/2013 Maggiore ..... A63H 33/062 446/120
D718,005 S * 11/2014 Hansen ..... D30/160
9,770,010 B2 * 9/2017 Wechsler ..... A01K 15/026
10,188,960 B2 1/2019 Berglund
2010/0210173 A1 * 8/2010 Maggiore ..... A63H 33/086 446/125

FOREIGN PATENT DOCUMENTS

CN 203469474 U 3/2016
KR 101079505 B1 11/2011
WO 8002234 A1 10/1980

OTHER PUBLICATIONS

"International Search Report," and "Written Opinion of the International Searching Authority" dated May 3, 2019, by the International Search Authority in PCT/CA2019/050225.

* cited by examiner

*Primary Examiner* — Kien T Nguyen
(74) *Attorney, Agent, or Firm* — David A. Jones; Nadesan Beck P.C.

(57) ABSTRACT

A hollow rigidly deformable geometric toy with a flat side and a mating joint construction. The toy has a plurality of faces which form a geometric cage and a plurality of apertures, and can contain an interior toy. The geometric toy is stably constructed such that it is safe for babies and children and suitable for teething and play.

17 Claims, 9 Drawing Sheets

GEOMETRIC TOY

CROSS REFERENCE TO RELATED APPLICATION

This application claims priority to Provisional U.S. Ser. No. 62/634,941 filed on Feb. 26, 2018, the contents of which is hereby incorporated by reference.

FIELD OF THE INVENTION

The present invention pertains to a hollow rigidly deformable geometric toy with a flat side. The present invention is also directed to a caged silicone toy with a mating joint construction.

BACKGROUND

Babies and children love to play with blocks, balls, and modular toys. Small children can have a difficult time grasping solid toys, and hollow toys or toys with skeleton structures are lighter, and easier to grasp, grip, and manipulate. In addition, many infants and small children love to put toys in their mouths to gum or chew, and toys with holes, bars, or skeletons can provide surfaces for children to put in their mouths. Toys with skeletons can also be attached via clips to other toys, as well as to cribs, strollers, or other baby gear.

U.S. Pat. Nos. 6,729,984 and 8,052,552 to Silverglate describes a deformable hollow ball having a mesh with loop structures disposed partially around an outer perimeter of each loop structure.

Geometric shapes are educational for young children, as well as pleasing to look at and play with. Toys such as blocks with flat sides can also be stacked in a variety of ways to create shape and structure combinations. Building blocks made of a variety of materials including cardboard, plastic, and wood are known, however hard corners and edges can cause damage or injury when thrown or when structures fall down. Balls with generally curved sides are designed to roll but are not stackable, nor do they provide corners or edges which fit into children's mouths for sucking, teething, or chewing. A geometric toy which is safe for children to put in their mouths and provides the benefits of structure building and mathematical and spatial exploration would be beneficial to children and parents.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a hollow rigidly deformable geometric toy with a flat side. Another object of the present invention is to provide a caged geometric toy with a mating joint construction.

In an aspect there is provided a geometric toy comprising a plurality of faces which together form a geometric cage comprising at least one edge; each face comprising at least one aperture, and at least one of the plurality of faces consisting of a flat plane, wherein at least one edge has at least one mating joint for joining the faces that form the at least one edge.

In another aspect there is provided a geometric toy comprising: a top face having a perimeter comprising a top mating edge; and a toy body consisting of a rigidly deformable material, the toy body comprising: a plurality of faces enclosing a space, each of the plurality of faces comprising at least one aperture; and an open body edge comprising a body mating surface complementary to the top mating edge, wherein the top mating edge of the top face is securably mateable with the body mating surface by deformation of the open body edge, to form a mating joint between the top mating edge and the open body edge.

In an embodiment, the toy further comprises an interior toy configured to be retained inside the geometric cage.

In another embodiment of the toy, the geometric shape further comprises surface features.

In another embodiment of the toy, the geometric toy is a cube.

In another embodiment of the toy, the interior toy comprises a rattle.

In another embodiment of the toy, the mating joint comprises a tongue and groove.

In another embodiment of the toy, the geometric shape comprises between 2 and 12 faces.

In another embodiment of the toy, the geometric shape has at least one truncated vertex.

In another embodiment, the toy further comprises means for attaching the geometric toy to another geometric toy.

In another embodiment, the toy further comprises suction elements.

In another embodiment, the toy further comprises at least one rounded edge.

In another embodiment, the mating joint extends around the perimeter of the top mating edge.

In another embodiment, the toy further comprises adhesive in the mating joint.

In another embodiment, the rigidly deformable material is silicone.

In another embodiment, the silicone has a hardness of 50-70 shore.

In another embodiment of the toy, at least one of the plurality of faces consists of a flat plane.

In another aspect there is provided a cube toy comprising: a cube comprising six faces, each face comprising at least one aperture; and an interior toy inside the cube, wherein the apertures are sized and shaped to retain the interior toy inside the cube, and at least one face of the cube is attached to edges of four other faces of the cube by a rigidly deformable mating joint.

In another aspect there is provided a geometric toy comprising: a geometric cage made of silicone comprising a plurality of faces forming at least one edge, each face comprising at least one aperture, at least one of the plurality of faces consisting of a flat plane; and an interior toy inside the geometric cage, wherein the apertures are sized and shaped to retain the interior toy inside the geometric cage.

In another aspect there is provided a method for forming a geometric cage, the method comprising: aligning the edges of a first face of the geometric cage comprising a rigidly deformable material and a second face of the geometric cage, the first face and the second face comprising complimentary mating surfaces which when joined form a mating joint; and stretching the edge of the first face to enable alignment of the complimentary mating surfaces. In one embodiment, the rigidly deformable material is silicone.

BRIEF DESCRIPTION OF THE FIGURES

For a better understanding of the present invention, as well as other aspects and further features thereof, reference is made to the following description which is to be used in conjunction with the accompanying drawings, where.

DETAILED DESCRIPTION OF THE INVENTION

Figure 1:
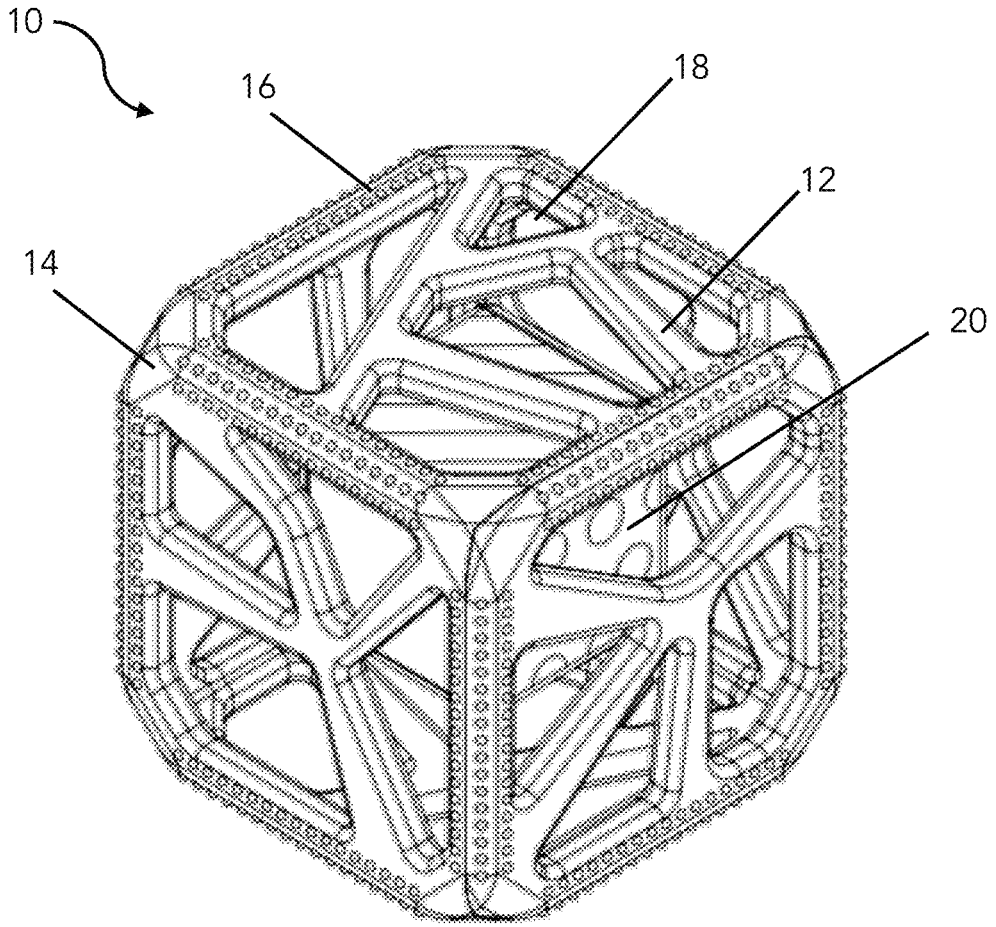
FIG. 1 is a perspective view of a geometric toy with an interior rattle.

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprising" as used herein will be understood to mean that the list following is non-exhaustive and may or may not include any other additional suitable items, for example one or more further feature(s), component(s) and/or element(s) as appropriate.

The term "geometric solid" is a term of art in mathematics that refers to a three dimensional shape having a plurality of surfaces or faces and forming an enclosed space. A face is understood to be a surface that forms part of the boundary of a solid object. Faces in the geometric solid can be planar, such as in a cube, or curved such as in a dome, cylinder, or cone. Although the term "solid" is used herein to describe the shape or configuration of the geometric toy, it is understood that the presently described toy has sides with a plurality of apertures creating a skeleton or cage, and that the toy structure is hollow.

The term "edge" as used herein refers to an extended segment that joins two vertices or faces. In geometric shapes where one of the faces is not flat, such as, for example, a dome or truncated cone, or it is understood that the edge is not required to be a straight line.

The term "vertex" as used herein refers to a point where two or more edges or faces meet. In a cube or rectangular prism, the vertex can also be referred to as a corner.

The term "truncated", as referring to a vertex of a geometric solid, describes a vertex that has been cut to create a new facet in place of the vertex.

Described is a geometric toy which is hollow and made from a rigidly deformable material. The present invention is also directed to a caged toy with an exterior skeleton and a mating joint construction that is suitable for play for small children and children of all ages. The faces of the geometric toy have apertures which form a skeleton or cage structure which can be grasped by small children. The edges and corners of the geometric toy are suitable for chewing or teething for small children and the material of the toy is safe and suitable for teething as well as play by small children. The geometric toy has at least one flat face which prevents rolling. The flat face also enables the geometric toy to be stacked, or to sit stably on a surface for play. The geometric toy can further enclose an interior toy which cannot be removed through the apertures of the geometric toy to provide additional stimulation and potential functionality to the geometric toy.

Advancements in silicone and plastic mold manufacturing have enabled construction of a wide variety of objects that meet the standards required for children's toys. However, standards required for children's toys are stringent, and extensive testing is required to establish safety. In particular, ASTM standard F963 (Standard Consumer Safety Specification for Toy Safety) requires at least one rigorous physical and/or mechanical test. Depending on the age group playing with the toy, certain strength tests must be passed to ensure safety. In one test called a push-pull test, a clip is placed on an accessible edge of the product, a weight is applied to the clip and the amount of weight is measured which will cause tear or breakage in the object. If the object tears too easily, shore or design must be changed to satisfy the standard such that the toy can be deemed safe.

The presently described geometric toy with hollow interior provides safe encapsulation of an interior toy that children can interact with but not remove the interior toy from the exterior geometric shell structure. A mating joint on at least one edge of the geometric toy provides secure attachment of the components of the geometric toy, and optional secure encapsulation of a toy within. Silicone mold construction with an opening in the shell or cage and complementary mating edges to form a mating joint between the cage components enables secure engagement of the silicone components capable of meeting safety standards for children's toys. The elasticity of silicone, both in its ability to stretch and to revert back to its original shape after stretching, referred to herein as rigidly deformable, allows for manufacturing of aligned and complementary mating edges which hold tightly once engaged. In one preferable mating edge configuration, one of the silicone components of the geometric toy has a channel at its edge and the other complementary component has a projection that aligns with and mates with the channel forming a tongue and groove type mating joint. The secure mating of channel and projection (or tongue and groove) at the edge of the geometric toy secures the components together in a seamless and secure configuration which is suitable and safe for children. In an example, one embodiment of the presently described toy passed the push-pull test at a weight of 15 kg, which exceeds the standard for 3+ months.

Silicone (polysiloxane) manufacturing has so far been challenged to accommodate cage-like structures that can withstand the push-pull forces required to adhere to the ASTM standard for children's toys, and also to securely enclose a smaller interior toy such that the cage can't be deconstructed under normal play or use conditions. 3D printing is also not presently amenable to such structures as printing takes a lot of time and the softer thermoplastics and silicones adapted for 3D printing are not suitable for children's toys. Without being bound by theory, the stretchability (flexibility), tensile strength, and malleability of rigidly deformable materials such as silicone enables the combination of molding, alignment, and adhesion of the mating joint that enables safe and sturdy cage-like structures to be made in a way that satisfies and exceeds the ASTM standard for children's toys. In particular, the silicone components can be stretched to accommodate fitting of the mating joint, and allow contraction to engage a snug fit. Placement of the joint in an interior of an edge of the toy provides further strength, directs any additional silicone adhesive to a hidden seam inside the construction edge, and provides a nearly invisible or invisible seam where the two parts meet. Silicone comes in various shores, which determine the firmness, or hardness or softness of the silicone. Acceptable shores for the present application are between 30-90 shore, and preferably 50-70 shore, with selection of the shore based on the required combination of stretchability, strength, tensile strength, and shape maintenance upon contraction.

Silicone can be washed in a conventional dishwasher and can withstand disinfection or sterilization temperatures. Silicone is further safe for babies and children to chew on, and more flexible than other polymers used for children's toys, which enables children to squish, grasp or chew. Silicone is also available in food grade and medical grade which is safe for infants and children who like to gum or chew on their toys. Silicone can be made BPA-free phthalate-free, metal-free, is latex-free and food-safe. Malleable toys have lower chance of injury when thrown and soft or bendable toys prevent damage to furniture for indoor play. Polymer toys can also bounce and can have a surface friction which supports structure building and stacking.

FIG. 1 is a perspective view of a geometric toy with an interior rattle. The geometric toy 10 shown is a cube, with a hollow interior enclosed by six faces 12. The faces meet at edges 16. An edge on a geometric shape is the place where two faces meet, in this case a straight line with a 90° angle between the two faces. Each face 12 has a plurality of apertures 18 through which the interior toy 20 is visible. The interior toy 20 can also be touched through the apertures 18 by a person or child putting their fingers into one or more aperture, or if the interior toy has a protrusion which can protrude through an aperture. Vertex 14, in this case is a truncated corner of the cube.

The construction of geometric toy 10, in this case a cube, is preferably accomplished with two molded pieces, a first piece with five sides and an open face, and a second piece having a single face. The open face of the first piece has a mating edge which is complementary to the outside edge or perimeter of the second piece. During construction, stretching of the open face of the first piece allows engagement of the mating edge of the first piece with the mating edge on the outside edge of the second piece, and releasing the stretch on the first piece allows for full engagement of the mating joint between the first and second pieces. The seam of the mating joint can be visible or invisible based on the placement of the mating joint on the two pieces, and the non-mating edges of the first piece can be textured to simulate a line or joint to further hide the location of the mating joint in the assembled structure. The mating joint can be further stabilized with an optional additional adhesive, applied during construction of the geometric toy.

Figure 2:
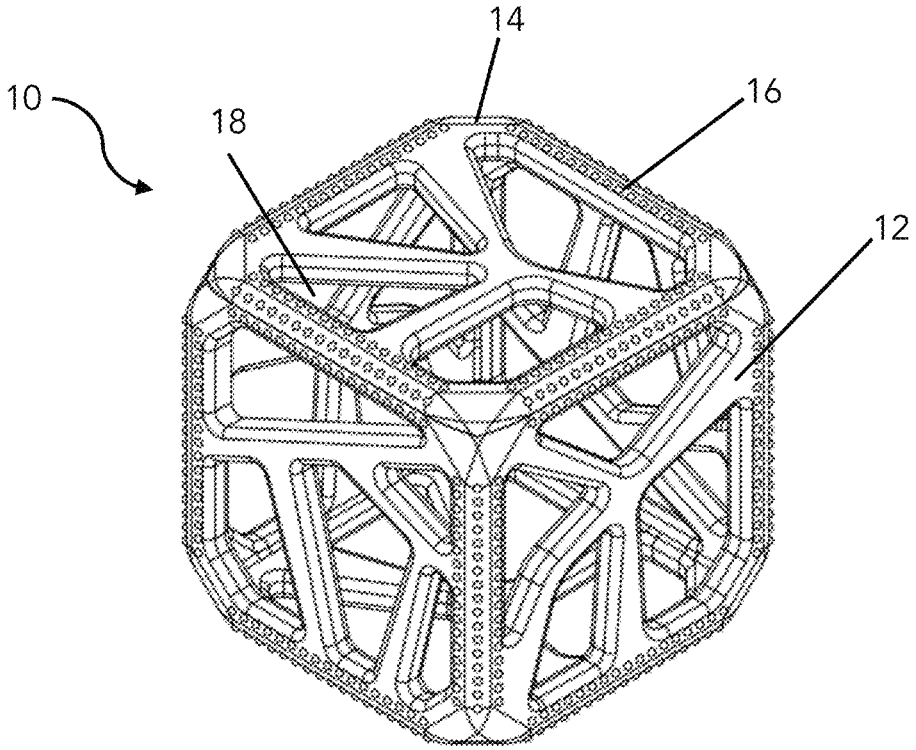
FIG. 2 is a perspective view of a geometric toy.

FIG. 2 is a perspective view of a geometric toy 10. The geometric toy shown in FIG. 2 is hollow and does not contain an interior toy. The toy is constructed to have the faces 12 of the geometric shape securely attached such that the faces form an integral geometric solid shape or cage. Secure attachment to form the geometric shape can be done by molding in various ways, including molding each face independently and attaching the faces together at mating surfaces, or molding more than one face at a time and attaching multiple faces together at mating surfaces at one or more edges 16. Preferably the geometric toy is constructed using a limited number of molded pieces, and preferably only two molded pieces. Further, limiting the number and total length of mating joints required for construction increases the durability of the structure. The mating surfaces can be engaged to form the geometric shape additionally using any suitable adhesive. The apertures 18 are preferably also geometric in shape to space fill the faces of the geometric toy. In one embodiment, the corners or vertices 14 of the geometric toy are rounded. Edges 16 can also be rounded. Vertex 14 shown is truncated or rounded, as are the other 7 vertices (corners) of the cube shown.

Figure 3:
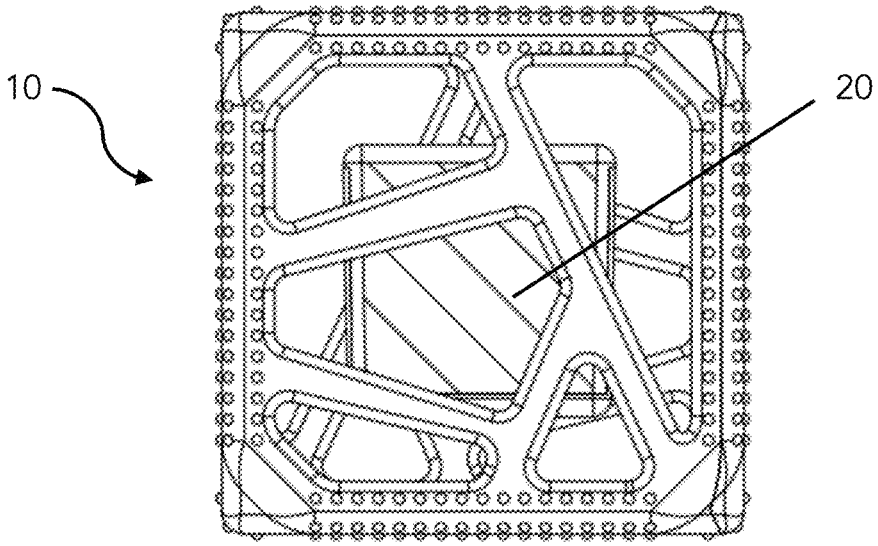
FIG. 3 is a front view of a geometric toy with an interior rattle.

FIG. 3 is a front view of a geometric toy 10 with an interior toy 20 rattle having a cube shape. The interior rattle is sized to be larger than any of the apertures in the faces of the geometric toy to retain the rattle inside the geometric toy. The interior toy shown is a cube, however it is understood that any interior toy which is sized to be larger than the apertures in the faces of the geometric toy would be suitable for encapsulation inside the cage of the geometric toy. In particular, the interior toy should be capable of being encasulated by the cage such that it can not be removed through the cage apertures. Other interior toys suitable for encapsulation include but are not limited to balls, figures, rattles, and rings. The interior toy may also optionally comprise a component that creates sound or light when the toy is manipulated.

Figure 4:
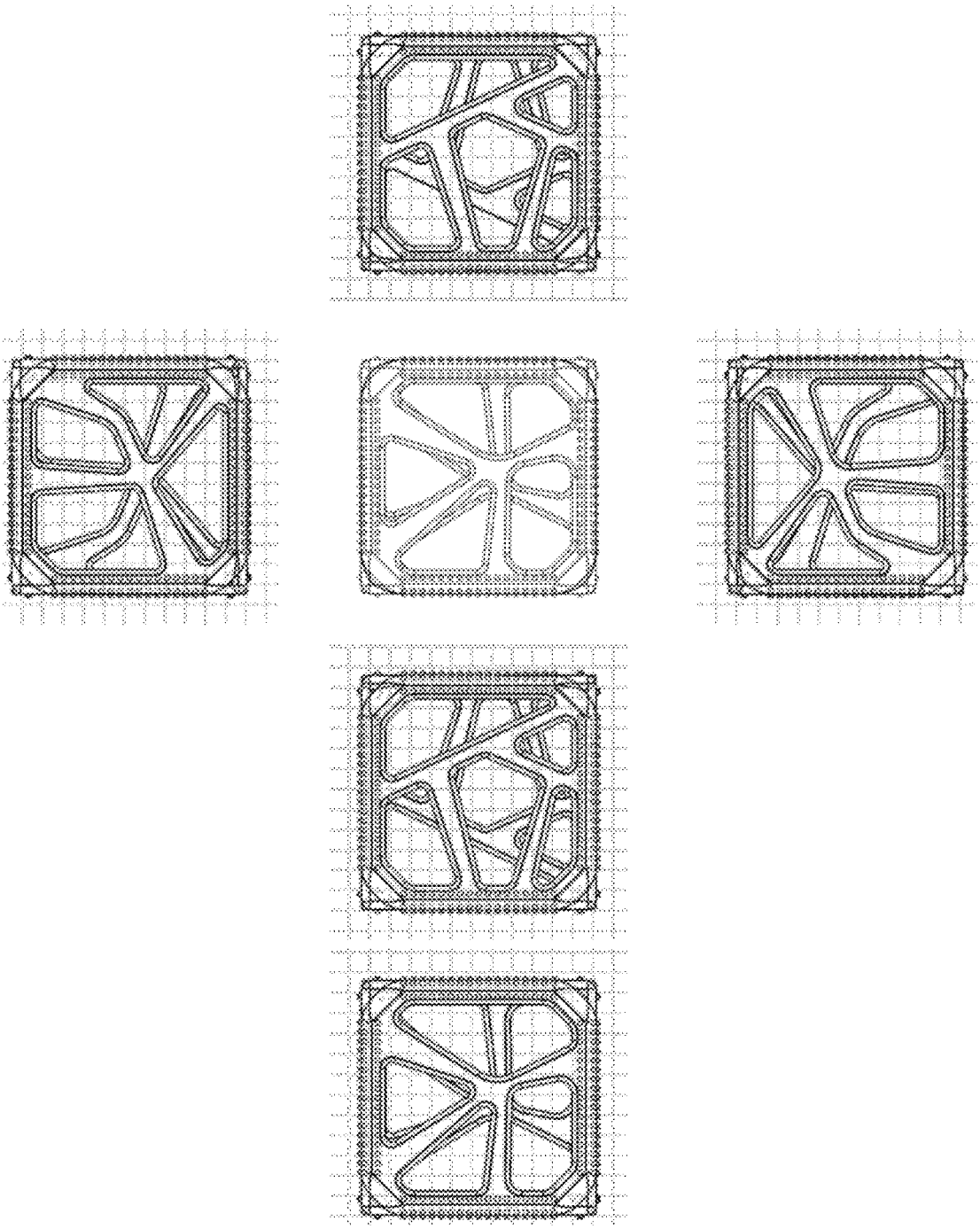
FIG. 4 is a front view of the sides of a geometric toy.

FIG. 4 is a front view of the sides of a geometric toy. The six faces shown each display the front of each face of the cube from the perspective at that face. The orientation, size, design, locations, and aesthetics of the apertures on each face of the geometric toy can be variable, and can be designed to form a multitude of patterns which can be the same or different on each face of the geometric toy.

Figure 5:
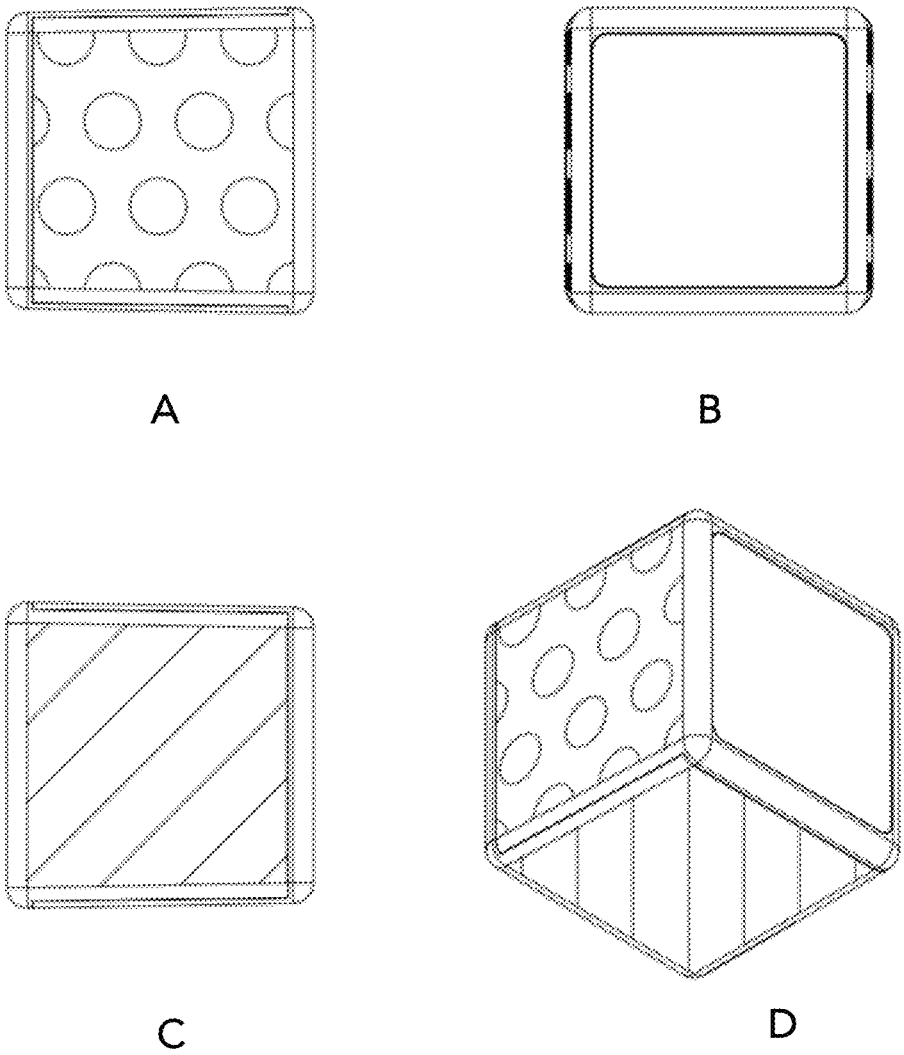
FIG. 5 shows different views of an interior object for the geometric toy.

FIG. 5 shows different views of an interior object for the geometric toy. Views A and C show two faces of an interior cube with dot and stripe patterns, respectively. Any image of interest to a child can be displayed, such as but not limited to geometric patterns, shapes, colours, and images of recognizable objects, animals, or people. View B is a mirror, which can optionally be on one side of the interior toy. The interior object shown can be manufactured from a hard plastic and can also optionally be a rattle comprising one or more objects or bell or other noisemaker inside to create a noise when shaken.

Figure 6:
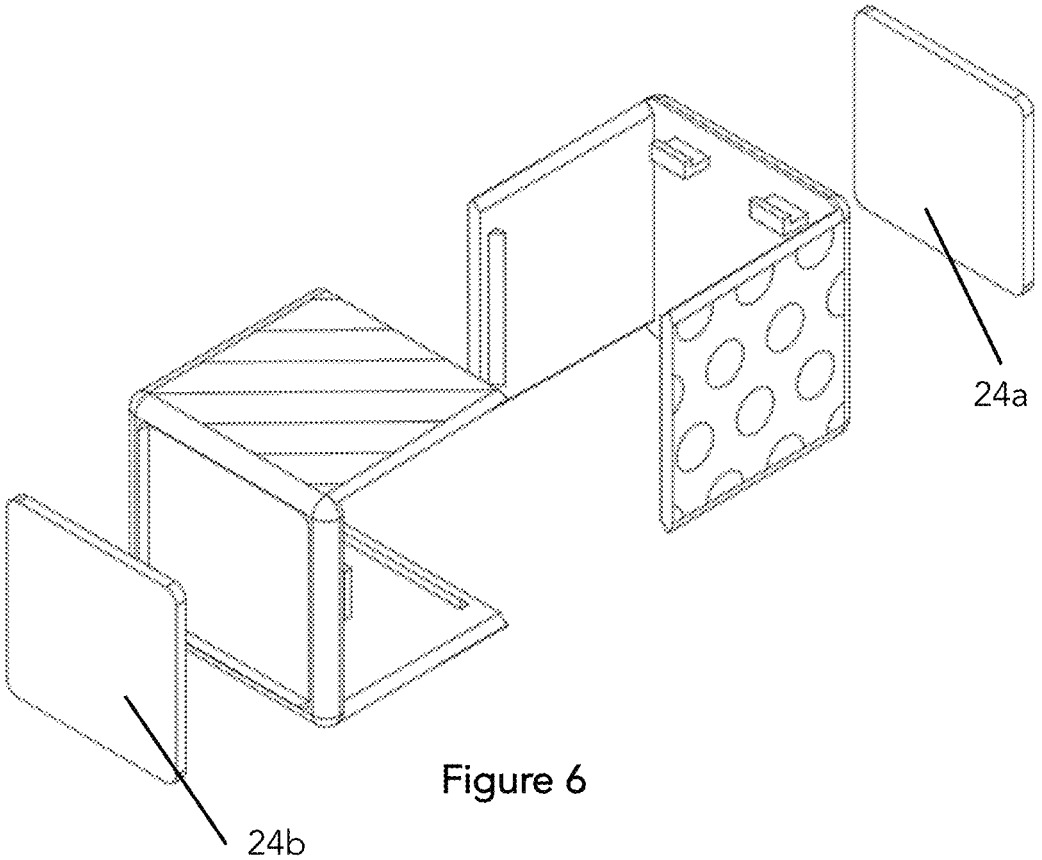
FIG. 6 is a perspective view of the construction of an interior rattle object.

FIG. 6 is a perspective view of the construction of an interior rattle object. As shown, the rattle cube is constructed from two U-shaped pieces each comprising three square faces connected at right angles with an interior latch mechanism to hold the formed cube together. Mirror features 24*a*, 24*b* can be added to sides of the interior object using a suitable adhesive.

Figure 7:
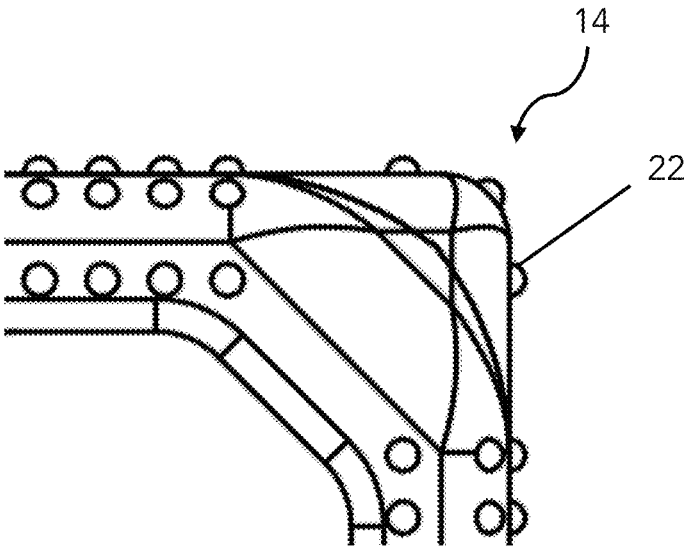
FIG. 7 is a close up view of one corner of a cube toy showing surface features.

FIG. 7 is a close up view of one corner of a cube toy showing surface features. The vertex 14 shown is one vertex of a geometric toy as described. Nubs 22 protrude from the edge of the geometric toy to provide surface interest as well as texture for an infant to grip, chew or gum. Other surface features such as indentations, striations, nubs, dips, and lips can be integrated into the silicone molding. The edge profile is also variable (shown in FIGS. 9 and 10) and the outside edge can shaped and textured for teething.

Figure 8:
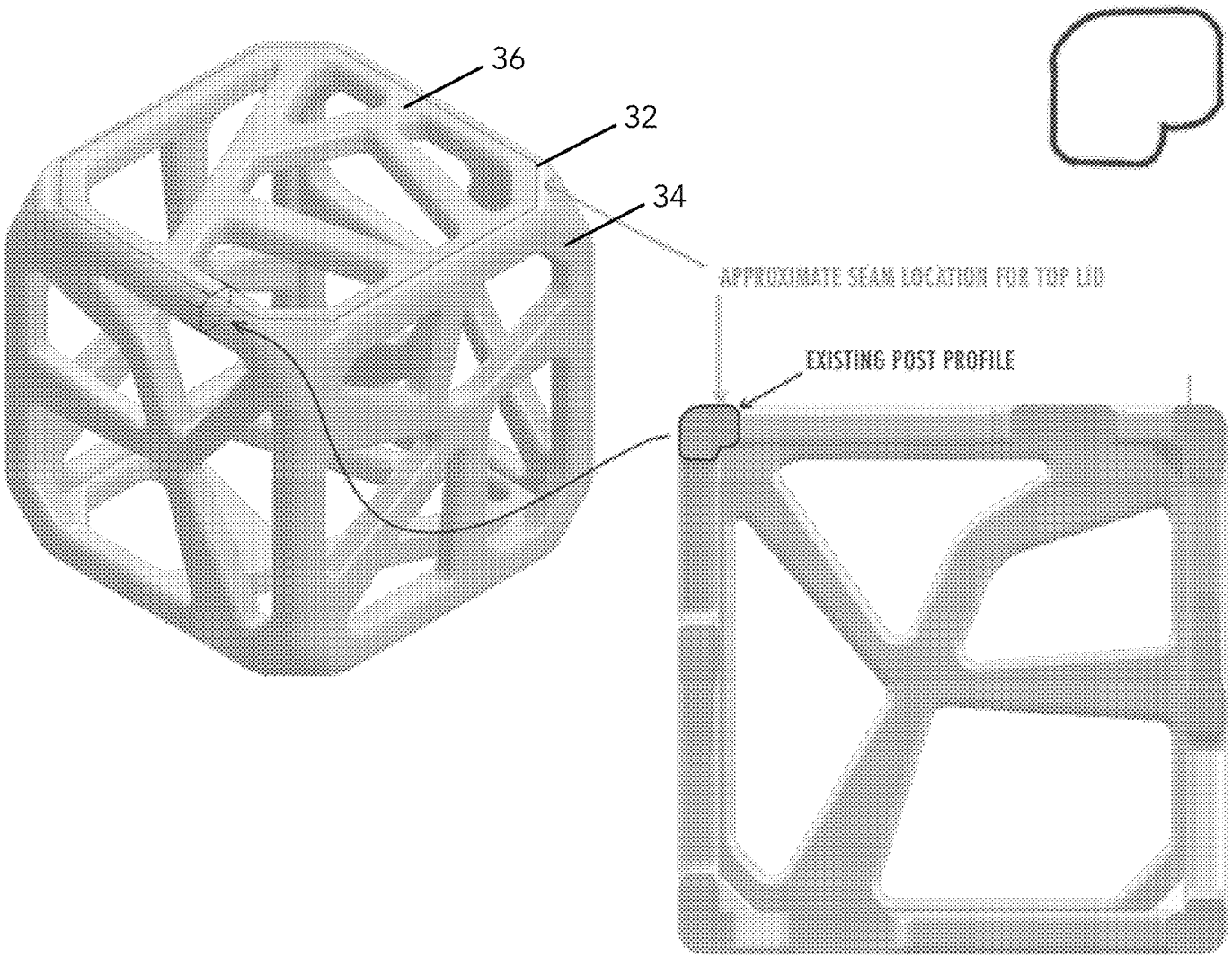
FIG. 8 is a perspective and plan view of the construction of a geometric toy with an L-shaped corner profile.

FIG. 8 is a perspective and plan view of the construction of the geometric toy with an L-shaped corner profile. As shown, a five-faced silicone cage is molded with a single faced lid molded separately. The approximate seam location where the lid fits into the open faced box is shown. The mating surface of the top face 36 and toy body 34 is a plane which joins at seam 32. During construction, the open face of toy body 34 is aligned around top face 36 to engage the mating surfaces on the top face 36 and toy body 34 fully around the diameter of top face 36 to form a mating joint. The other faces of the toy body can further be textured with a line that looks like the seam 32 to conceal the location of the seam. The mating joint can be further secured with an appropriate adhesive.

Figure 9:
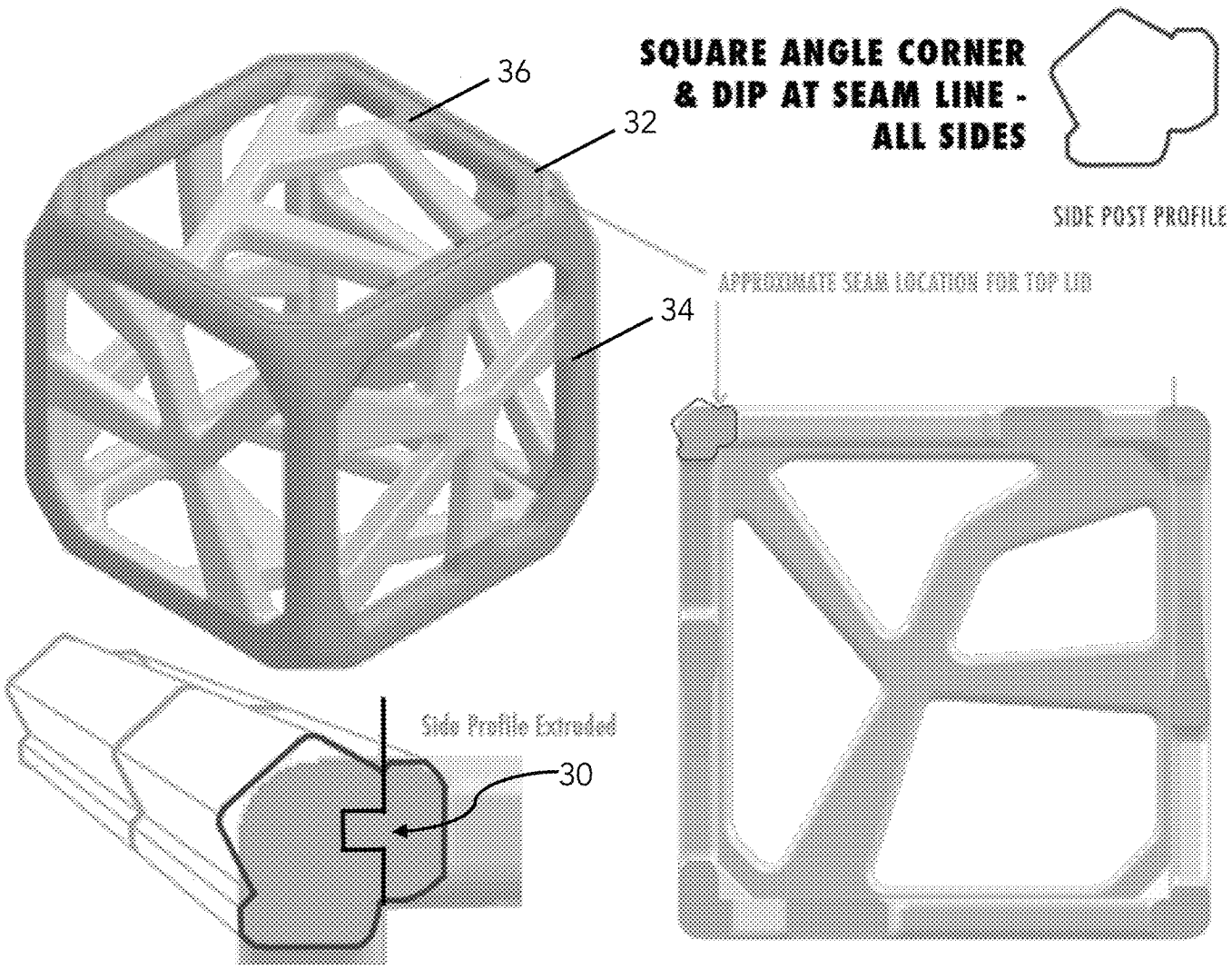
FIG. 9 is a perspective and plan view of the construction of a geometric toy with a square angled corner side post profile and tongue and groove mating joint.

FIG. 9 is a perspective and plan view of the construction of a geometric toy with a square angled corner side post profile and tongue and groove mating joint. The five-faced silicone cage toy body 34 is molded with a single faced lid top face 36 molded separately with an extended edge. The extended edge provides additional support for the tongue and groove mating joint 30. The approximate seam 32 location where the lid fits into the open faced box is shown. The tongue is shown here as a feature of the edge of the lid with the groove as a feature of the inside edge of the open face on the five-faced cube cage, however it is understood that the reverse may also be constructed, with the tongue on the box and the groove on the lid. When the lid is fitted inside the open face of the five-faced cube box, the box opening is stretched such that the tongue(s) on the lid can be positioned inside the groove(s) of the cage opening. An adhesive is preferably used to further secure the two pieces together in the mating joint 30. The tongue and groove can be a single tongue and groove which extend around the circumference of the lid and open edge of the cage, or can comprise multiple tongue and groove joints positioned around the circumference of each piece at mating locations. Other mating joints may also be used, including but not limited to multiple tongue and groove joints (finger joints), and other doweled, splined, or mortice and tenon type joints wherein a protrusion on one of the mating faces securely fits into an aperture on the corresponding mating face. It is also conceivable that the mating edges could each have holes or apertures to insert joining dowels or biscuits, preferably also made of silicone, which may be further adhered using adhesive. It is preferable, however, that the mating or joining features be an integral construction with the silicone cage to prevent potential issues of small unattached pieces which can be a choking hazard. With the mating surface on the edge circumference, the seam can be hidden and any glue or adhesive is on the internal edge of the toy. The mating joint that is created between mating edges of the open box and lid fits like a puzzle and can only be aligned by stretching the silicone, which provides strength when the silicone relaxes to its normal shape.

Figure 10:
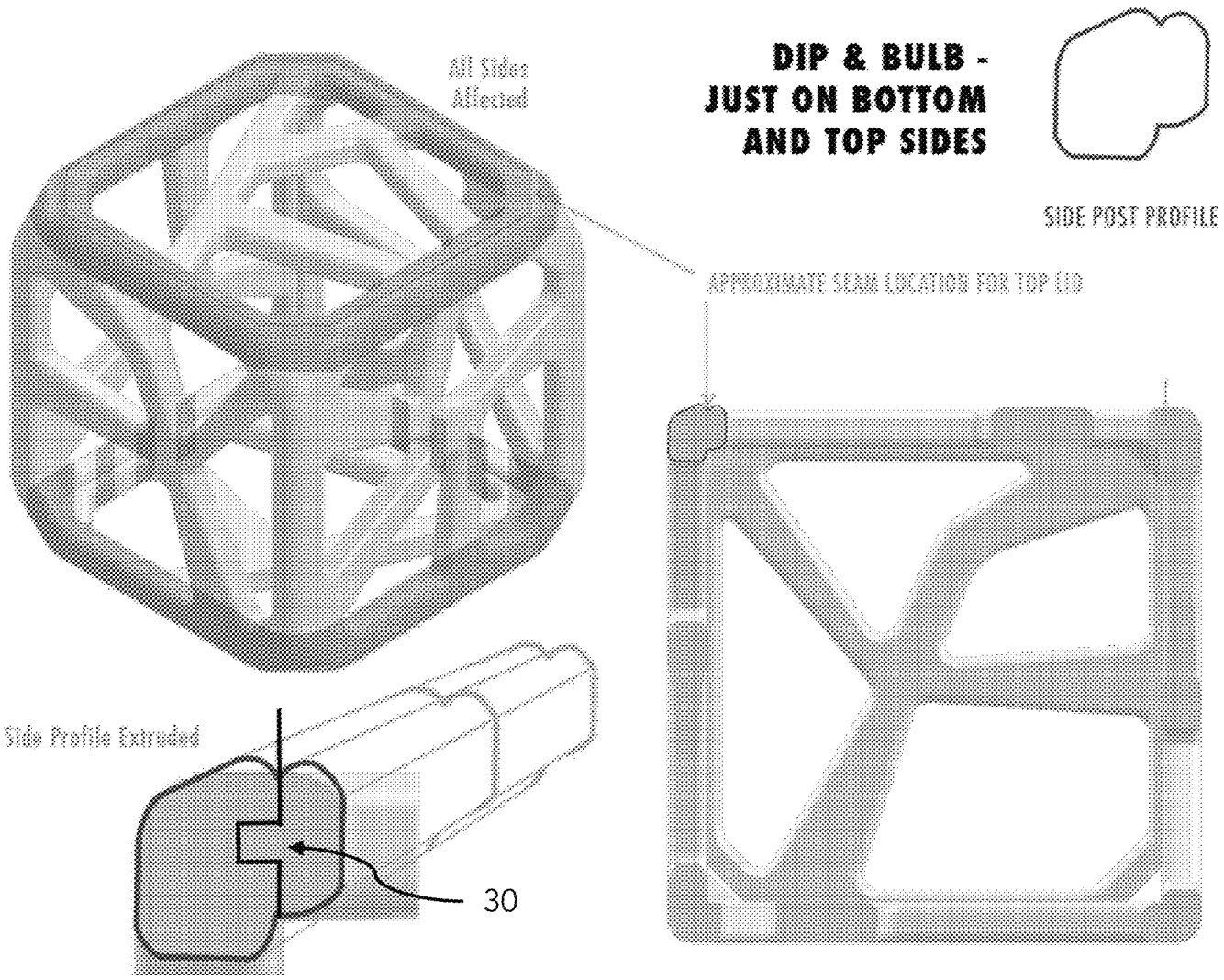
FIG. 10 is a perspective and plan view of the construction of a geometric toy with dip and bulb side post profile and tongue and groove mating joint.

FIG. 10 is a perspective and plan view of the construction of a geometric toy with a dip and bulb side post profile and a tongue and groove mating joint 30. Compared to the square angled corner grooved mating joint shown in FIG. 9, this dip and bulb side post profile is rounder and provides a different finger and mouth feel for babies and children to hold and chew on.

Figure 11:
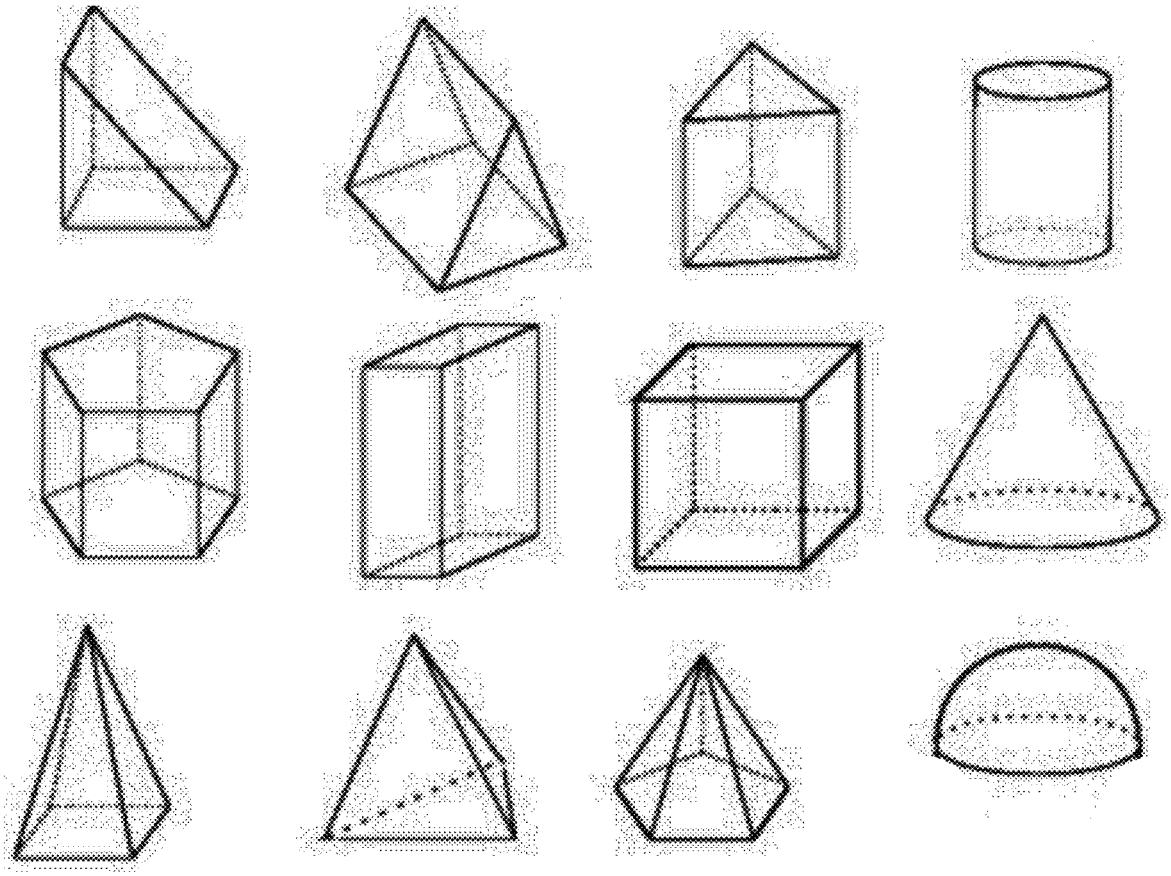
FIG. 11 is a perspective view of geometric shapes for the geometric toy.

FIG. 11 is a perspective view of a variety of possible geometric shapes for the geometric toy. The geometric toy can be of any geometric solid shape. Non-limiting examples of geometric solids include a cylinder, cone, rectangular box, cuboid, triangular prism, octahedron, dodecahedron, isocahedron, cube, half-sphere or hemisphere, cone, tetrahedron, triangular based pyramid, square based pyramid, flat-topped pyramid, pentagonal based pyramid, and hexagonal based pyramid. One or more vertex of the geometric toy can also be truncated.

The geometric toys described can further have means for attachment one to the other. Suction elements, nubs and aligned indentations, mating protrusions and holes, and elongated protrusions and mating indentations on one or more edges, faces, and/or vertices, can all be used to provide reversible attachment locations to support stacking or temporary attachment of two or more geometric toys. The high friction nature of silicone further enables mating and stacking of elements and prevents slipping of one silicone toy relative to another, or relative to a surface. Connector parts can further be on a part on the interior of the geometric toy such that two geometric toys can be releasably connected. These can include mateable features such as, for example, complementary pegs and holes. Friction fit of these complementary features can enable secure but releasable connection by small children. Alternatively, the geometric toy can also be provided together with clips, joins, hooks, clamps, or connector rings, to reversibly secure two or more geometric toys together, or to releasably attach one or more geometric toy to another toy or piece of baby gear such as a high chair, stroller, crib, car-seat, or play structure. Other accessories can be provided including with adjacent holes or connection regions, which can be placed at a variety of locations or orientations on the geometric toy. Various lightweight structures can safely built with the present geometric toys by users of all ages. The structures can either be freestanding, with multiple toys balanced on one another, or connected by way of connector parts which are either attached or integrated into the skeleton structure of the geometric toys or can be attached and removed from the toy skeletons. Multiple toys can also be permanently connected through their vertices and sold in chains of 2, 3, 4 or more. In particular, two geometric toys can be connected through the respective apertures on an edge or vertex such that the toys are linked. The geometric toys can further have one or more features to releasably secure the toy to a surface such as suction elements. Integrated surface features such as indentations can serve as suction elements when the geometric toy is made of a deformable material, especially when played with in a bath or pool with flat or tiled we surfaces. The toy can be any color, or combination of colors.

All publications, patents and patent applications mentioned in this specification are indicative of the level of skill of those skilled in the art to which this invention pertains and are herein incorporated by reference. The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. A geometric toy comprising:

a top face having a perimeter comprising a top mating edge; and a toy body comprising a rigidly deformable material, the toy body comprising:

a plurality of faces enclosing a space, each of the plurality of faces comprising at least one aperture; and an open body edge comprising a body mating surface complementary to the top mating edge of the top face, wherein the top mating edge of the top face includes interlocking features that mate with and are adhered to corresponding interlocking features of the body mating surface of the open body edge by adhesive to form a secure joint between the top mating edge and the open body edge.

2. The geometric toy of claim 1, further comprising an interior toy configured to be retained inside the space.

3. The geometric toy of claim 2, wherein the interior toy comprises a rattle.

4. The geometric toy of claim 1, wherein the geometric toy further comprises chewable teething surface features.

5. The geometric toy of claim 1, wherein the geometric toy is cube-shaped.

6. The geometric toy of claim 1, wherein the top mating edge of the top face is securably mateable with the body mating surface by deformation of the open body edge.

7. The geometric toy of claim 1, wherein the mating joint comprises a tongue and groove.

8. The geometric toy of claim 1, wherein the geometric shape comprises between 2 and 12 faces.

9. The geometric toy of claim 1, wherein the geometric shape has at least one truncated vertex.

10. The geometric toy of claim 1, further comprising means for attaching the geometric toy to another geometric toy.

11. The geometric toy of claim 1, further comprising at least one rounded edge.

12. The geometric toy of claim 1, wherein the mating joint extends around the perimeter of the top mating edge.

13. The geometric toy of claim 1, wherein the rigidly deformable material is silicone.

14. The geometric toy of claim 13, wherein the silicone has a hardness of 50-70 shore.

15. The geometric toy of claim 1, wherein at least one of the plurality of faces consists of a flat plane.

16. A geometric toy comprising:

a geometric cage comprising a rigidly deformable material comprising a plurality of faces forming at least one edge, each face comprising at least one aperture, at least one of the plurality of faces consisting of a flat plane, wherein one face of the cage is securely attached by a rigidly deformable mating joint and adhesive; and an interior toy inside the geometric cage, wherein the apertures are sized and shaped to retain the interior toy inside the geometric cage.

17. The geometric toy of claim 16, wherein the geometric cage is a cube and includes only two molded pieces the first molded piece having five sides and an open face, and a second piece having a single face, and the second piece is attached to the edges of four other faces of the first piece by the rigidly deformable mating joint and adhesive.

* * * * *